US005549032A

United States Patent [19]

Long

[11] Patent Number: 5,549,032

[45] Date of Patent: Aug. 27, 1996

[54] LOW-POLLUTION HIGH-POWER EXTERNAL COMBUSTION ENGINE

[76] Inventor: Otto V. Long, P.O. Box 370, Beaver Creek, Oreg. 97004

[21] Appl. No.: 428,884

[22] Filed: Apr. 25, 1995

[51] Int. Cl.[6] ..... F01B 3/10

[52] U.S. Cl. ..... 91/502; 417/269

[58] Field of Search ..... 91/502, 499; 417/269; 123/43 A

[56] References Cited

U.S. PATENT DOCUMENTS

| | | | |
|---|---|---|---|
| 893,181 | 7/1908 | Macomber | 91/502 |
| 991,699 | 5/1911 | Cassady | 91/502 |
| 1,277,964 | 9/1918 | Lovelace | 123/43 A |
| 1,293,080 | 2/1919 | Gilman | 91/152 |
| 1,807,087 | 5/1931 | Finke | 123/43 A |
| 1,880,224 | 10/1932 | Wilsey | 123/43 A |
| 2,087,567 | 7/1937 | Blum | 91/502 |
| 2,115,556 | 4/1938 | Maniscaleo | 91/8 |
| 2,157,692 | 5/1939 | Doe et al. | 91/490 |
| 2,391,575 | 12/1945 | Huber | 91/480 |
| 2,672,819 | 3/1954 | Widmer | 417/269 |
| 2,753,802 | 7/1956 | Omohundro | 417/258 |
| 2,785,639 | 3/1957 | Huber | 91/478 |
| 3,007,420 | 11/1961 | Budzich | 91/499 |
| 3,188,963 | 6/1965 | Tyler | 417/225 |
| 3,265,008 | 8/1966 | Ward | 91/490 |
| 3,333,478 | 8/1967 | Papst | 74/60 |
| 3,382,793 | 5/1968 | Gantzer | 91/499 |
| 3,495,402 | 2/1970 | Yates | 60/641.6 |
| 3,514,223 | 5/1970 | Hare | 417/269 |
| 3,568,574 | 3/1971 | Dupen | 103/162 |
| 3,601,012 | 8/1971 | Oram | 103/162 |
| 3,611,879 | 10/1971 | Alderson | 91/490 |
| 3,616,726 | 11/1971 | Ruger | 91/488 |
| 3,663,122 | 5/1972 | Kitchen | 417/269 |
| 3,695,237 | 10/1972 | Londo | 123/43 A |
| 3,939,809 | 2/1976 | Rohs | 123/43 A |
| 3,970,055 | 7/1976 | Long | 123/43 A |
| 4,363,294 | 12/1982 | Searle | 123/43 A |
| 4,779,579 | 10/1988 | Sukava et al. | 123/43 A |
| 5,000,667 | 3/1991 | Taguchi et al. | 417/222 |

FOREIGN PATENT DOCUMENTS

| | | |
|---|---|---|
| 2914 | of 1914 | United Kingdom . |
| 204440 | 10/1923 | United Kingdom . |
| 557736 | 11/1943 | United Kingdom . |

*Primary Examiner*—Timothy S. Thorpe
*Assistant Examiner*—Peter G. Korytnyk
*Attorney, Agent, or Firm*—Chernoff, Vilhauer, McClung & Stenzel

[57] ABSTRACT

A low-pollution external combustion piston engine is adapted to utilize any of a number of expansible gases and fuels, and to maximize power output relative to the weight of the engine. The engine has a highly efficient and compact rotary design featuring a multi-cylinder rotary block acting on a rotary torque conversion plate. The design includes porting and valving for controllably admitting pressurized gas at substantially equal pressures to both sides of each piston to drive each piston bidirectionally and thereby maximize power output and efficiency. Each piston chamber has both primary and secondary exhaust porting to minimize back pressure and thereby further aid power output and efficiency.

9 Claims, 2 Drawing Sheets

LOW-POLLUTION HIGH-POWER EXTERNAL COMBUSTION ENGINE

BACKGROUND OF THE INVENTION

This invention relates to improvements in low-pollution external combustion engines of the type which generate power by the expansion of a nonburning gas. More particularly the invention relates to improvements in a piston-driven engine of this type for maximizing the power output thereof.

The increasing demand for low-pollution automobile engines and other power plants has indicated a strong need for replacement of the internal combustion engine. The steam engine, able to capitalize on the low emission advantages of external combustion and the simplified mechanics and drive train made possible by high starting torque and a reversible engine, is one likely successor. Other possibilities include external combustion engines utilizing freon, thiophene or other similar elastic fluids. In addition to low emissions, a further advantage of external combustion engines is that they are capable of using any heat-producing combustible fuel, as well as solar or geothermal energy sources. In any automotive engine, it would appear that pistons must be utilized rather than turbines, since turbines require very high volumes, lack low-speed torque and work best at relatively constant high speeds, thereby requiring substantial gear reduction.

Despite their low-pollution and multi-fuel advantages, the relatively low power-to-weight ratio of conventional external combustion piston engines has made them unattractive for automotive use. This disadvantage has not been overcome by efficiency-improving measures such as the development of the "uniflow" principle of exhaust porting, whereby the expansible fluid flows from the end of the cylinder to exhaust ports located near the longitudinal center of the cylinder and thus does not reverse its direction of flow during exhaust. This elimination of exhaust flow through inlet ports is important because it substantially eliminates a particular type of energy loss known to those skilled in the art as "initial condensation," thereby improving the efficiency of the external combustion engine.

I previously proposed another efficiency-improving measure in my U.S. Pat. No. 3,970,055, which provided improved gas expansion by conducting the exhaust from one side of a piston to the opposite side thereof.

However, such improvements in thermal efficiency have not improved the power-to-weight ratio of external combustion engines sufficiently to make them attractive for automotive use, despite their low-pollution and multi-fuel advantages.

SUMMARY OF THE PRESENT INVENTION

The present invention is directed to an improvement in the engine disclosed in my prior U.S. Pat. No. 3,970,055, which improvement drastically increases (by approximately 100%) the power output of my previous engine design without requiring an increase in its size or weight. This objective is accomplished by providing porting and valving which admit pressurized gas at substantially equal pressures to both sides of each piston to drive each piston bidirectionally, in a manner consistent with the efficient and compact rotary design of the engine.

In order to accomplish the foregoing power increase, the improved gas expansion feature of my previous engine design has been eliminated, but efficiency is nevertheless substantially preserved by the retention of the uniflow principle of exhaust porting in combination with secondary exhaust porting to minimize back pressure and thereby further improve power output and efficiency.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
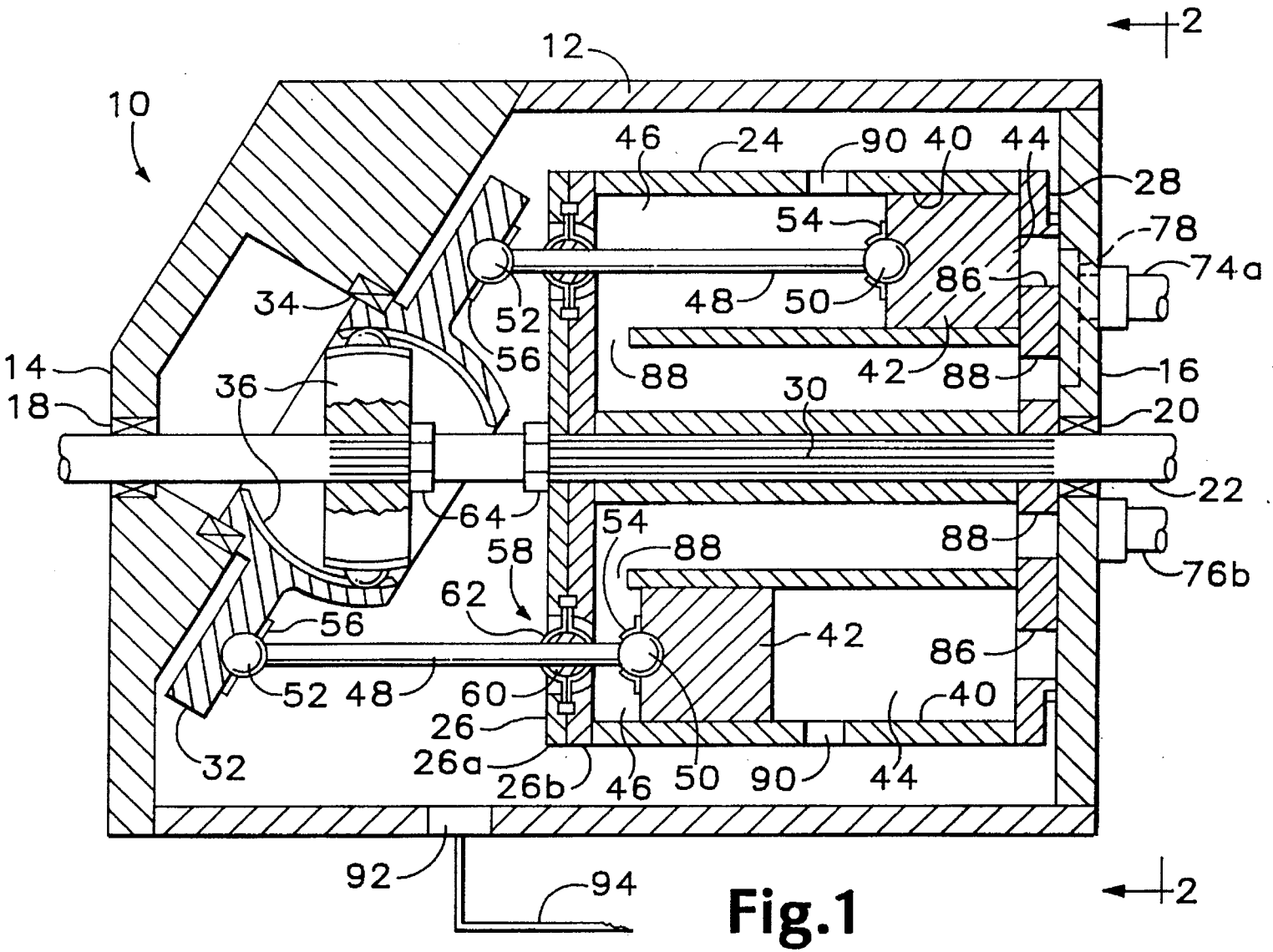
FIG. 1 is a simplified, partially schematic axial sectional view of an exemplary embodiment of an engine in accordance with the present invention.

To the extent applicable, features of the engine shown in my previous U.S. Pat. No. 3,970,055, which is hereby incorporated by reference, may be used in conjunction with the engine of the present invention.

The preferred embodiment of the present invention, designated generally as 10, comprises an engine housing 12 having opposite axial ends 14 and 16 encasing axially-aligned journal bearings 18 and 20. The bearings 18 and 20 mount a rotatable drive shaft 22 extending through each end of the housing for attachment to a driven load, which may be automobile wheels or other mechanisms as desired. Power transmissions or other gearing may be connected to the drive shaft 22 but normally are not required since the engine is inherently reversible, has high torque regardless of engine speed (even when stalled), and does not "idle."

A cylinder block 24 having a pair of detachable heads 26 and 28 is mounted within the housing 12 supported by the drive shaft 22. Splines 30 or other suitable means fix the cylinder block 24 to the shaft 22 so that the two rotate in unison.

At one end of the cylinder block 24 a circular torque conversion plate 32 is mounted to the housing 12 by a bearing 34 so as to rotate about an axis which is tilted with respect to the axis of the drive shaft 22. The torque conversion plate 32 is connected to the shaft 22 by a constant velocity universal joint 36 so that the two rotate in unison. If desired, an output shaft (not shown) could be driven by the plate 32, and/or the shaft 22 could terminate at the universal joint 36.

Inside the cylinder block 24 a plurality of cylinders 40 are formed with their axes parallel to the axis of the drive shaft 22. Preferably six such cylinders are equally spaced radially about the axis of the drive shaft and cylinder block, although other numbers of cylinders could be used. Each cylinder includes an axially-reciprocating piston 42 and defines a pair of gas expansion chambers 44, 46 separated by the piston 42. Each piston has a respective piston rod 48 extending from a ball joint 50 through the cylinder block head 26 to the torque conversion plate 32 where it is likewise connected through a ball joint 52 for universal movement. The ball joints 50 and 52 are connected to the pistons 42 and torque conversion plate 32, respectively, by respective ball joint sockets 54 and 56 enabling both tension and compression forces to be exerted through the rods 48 between the pistons 42 and plate 32. Each rod 48 slides longitudinally through a respective seal assembly 58, which comprises a ball 60 slidably mounted on the rod 48 and captured within a ball socket 62 having flanges which are slidable in multiple directions transverse to the rod 48 between the adjacent plates 26*a* and 26*b* of the head 26. This transverse sliding motion of the seal assemblies 58 compensates for the fact that the path of travel of the joints 52 when viewed in a plane perpendicular to the axis of the drive shaft 22 is elliptical rather than circular, thereby requiring the seal assemblies 58 to gyrate slidably with respect to the head 26 as the cylinder block 24 rotates. The rods 48 are free to rotate axially with respect to the seal assemblies 58 so that the gyrating motion of the seal assemblies causes gradual rotation of the rods 48, as well as of the pistons 42, during operation which provides even wear of these parts relative to their adjacent parts.

Figure 3:
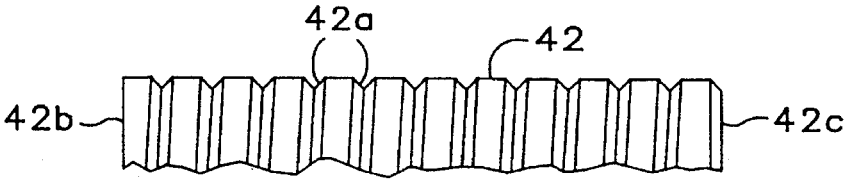
FIG. 3 is an enlarged partial detail view of a piston of the engine of FIG. 1.

With reference to FIG. 3, each piston 42 preferably has a continuous helical thread 42*a* formed in its exterior surface communicating with both ends 42*b* and 42*c* of the piston. The continuous thread takes the place of piston rings and carries friction-reducing lubricating gas from both sides of the piston to minimize wear and temperature.

The bearings 34 of the torque conversion plate 32 provide resistance to the compression forces exerted by the rods 48 on the plate 32, while the universal joint 36 provides resistance to the tension forces exerted by the rods 48 on the plate 32. Nuts 64 on the drive shaft 22 adjustably hold the cylinder block 24 and universal joint 36 apart.

Figure 2:
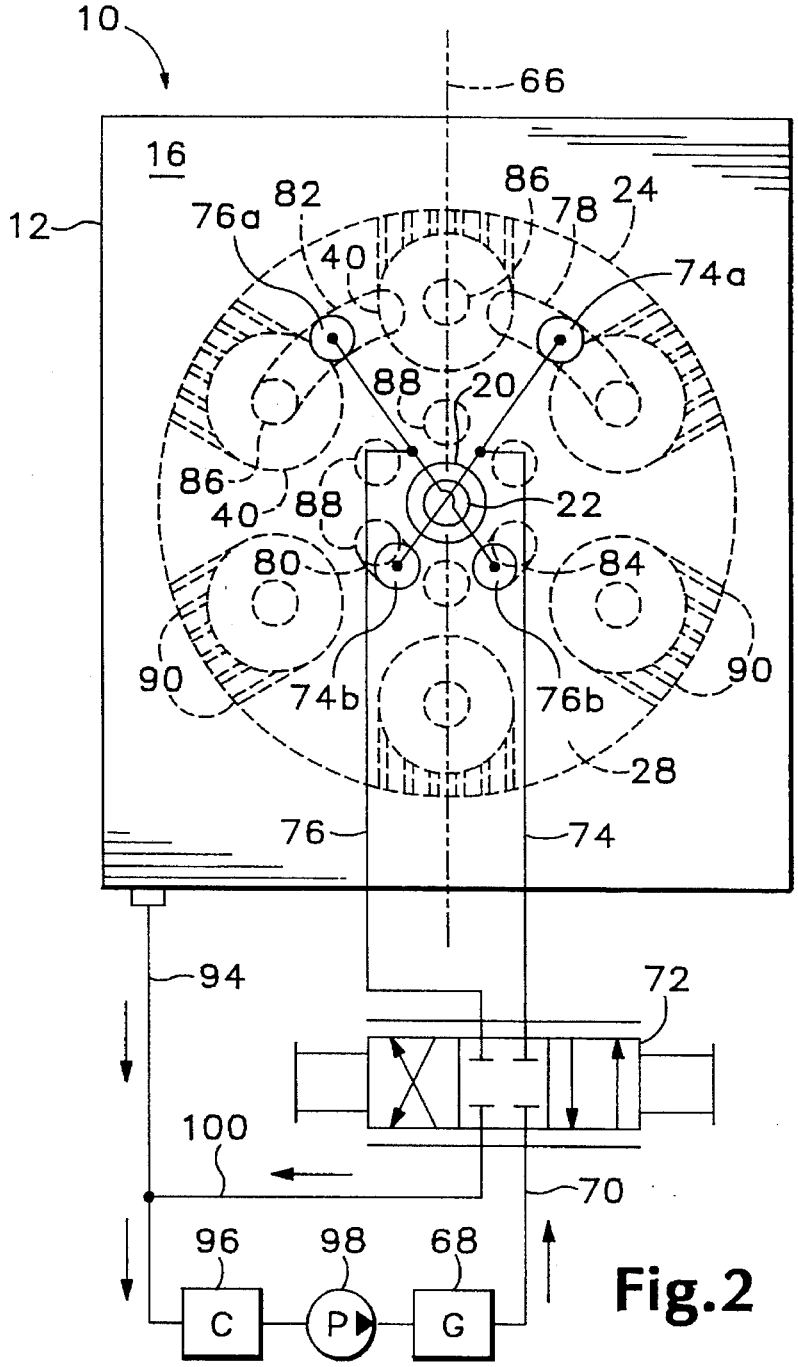
FIG. 2 is a simplified, partially schematic end view taken along line 2–2 of FIG. 1.

With reference to FIG. 2, an imaginary vertical plane 66 is shown passing through the axis of the drive shaft 22. If all pistons on one side of such plane 66 exert a compression force through their rods 48 against the circular torque conversion plate 32 while all pistons on the opposite side of such plane simultaneously exert a tension force through their rods 48 on the plate 32, the cylinder block 24, plate 32 and drive shaft 22 will all rotate in unison pursuant to the power developed by the combined compression and tension forces in the piston rods 48. Reversing the compression and tension forces with respect to the plane 66 will cause rotation in the opposite direction.

Accordingly, in operation, pressurized gas is fed from any suitable generator 68, such as a steam or freon boiler, through a conduit 70 to an infinitely variably, reversible spool valve 72 which may be operated manually, electrically, or by fluid power as desired. Depending upon whether the spool of the valve 72 is moved to the left or to the right from its centered position shown in FIG. 2, the pressurized gas will be fed either to conduit 74 or 76, respectively. Each conduit 74, 76 is connected to a respective pair of ports 74*a*, 74*b* and 76*a*, 76*b*, respectively, each pair of ports being located on opposite sides of the vertical plane 66. Each port 74*a*, 74*b*, 76*a*, 76*b* passes through the end 16 of the housing 12 into a respective arcuate cavity 78, 80, 82 or 84 formed on the inside of the end 16 and opening inwardly toward the head 28 of the cylinder block 24.

Each chamber 44, 46 of each cylinder 40 has a respective inlet port 86 or 88, respectively, communicating with the end 16 of the housing 12 through the head 28. The inlet ports 86, which communicate with the right-hand cylinder chambers 44 as seen in FIG. 1, are spaced radially outwardly of the inlet ports 88 which communicate with the left-hand chambers 46. The radially-outward ports 86.are positioned so as to be alignable with the cavities 78 and 82 associated with the ports 74*a* and 76*a*, respectively, depending upon the rotational position of the head 28 relative to the stationary end 16 of the housing 12. Likewise, the inlet ports 88 are positioned so as to be alignable with the cavities 80 and 84 of the ports 74*b* and 76*b*, respectively, depending upon the rotational position of the head 28. Accordingly the end 16 cooperates with the head 28 to perform a valve function, in conjunction with the valve 72, as the engine rotates.

When the spool of valve 72 is moved toward the left from its centered position as shown in FIG. 2, conduit 74 is exposed to pressurized gas from conduit 70 which in turn is fed to ports 74*a* and 74*b*, and their associated cavities 78 and 80 simultaneously. This sequentially pressurizes chambers 44 of those cylinders located on the right side of the imaginary plane 66 as their inlet ports 86 rotate into alignment with the cavity 78, while sequentially also pressurizing chambers 46 of those cylinders located on the left side of the plane 66 as their inlet ports 88 rotate into alignment with the cavity 80. Thus, the right-hand pistons apply compressive forces against the torque conversion plate 32, while the left-hand pistons simultaneously apply tension forces against the plate 32. This causes the engine to rotate clockwise as seen in FIG. 2 with each piston alternately pushing and pulling against the plate 32 during each revolution of the block 24, thereby producing twelve power impulses per revolution from the six cylinders. Conversely, if the spool of valve 72 is moved to the right from its centered position in FIG. 2, the engine is similarly driven counterclockwise by feeding pressurized gas through conduit 76 and ports 76*a* and 76*b*. Such reversal of the valve 72, or centering of the valve, while the load continues to move in its original direction, will provide powerful frictionless braking which is particularly valuable for heavy vehicles. In each case, the infinite variability of the valve 72 enables variable control of engine power or braking force, as the case may be, by regulating the gas flow depending on how far the spool of the valve 72 is moved from its centered position.

At the end of each compression or tension stroke of each piston 42, the pressurized gas in the respective chamber 44 or 46 is exposed to a centrally-located exhaust port array 90 which opens due to the piston's movement, allowing the expanded gas to escape radially outwardly into the interior of the housing 12 from which it is exhausted through an outlet 92 and conduit 94 to a condenser 96. A condensate pump 98 returns the condensed liquid to the generator 68 and the flow recirculates in a closed-loop fashion.

When either conduit 74 or 76 is supplied with pressurized gas by the valve 72, the other conduit is not closed but rather is connected by the valve 72 to the exhaust conduit 94 through conduit 100, and thereby to the input of the condenser 96. This latter connection enables the inlet ports 86 of the chambers 44 to serve as secondary exhaust ports while their opposing chambers 46 are expanding under the force of pressurized gas, while similarly enabling the inlet ports 88 of chambers 46 to serve as secondary exhaust ports while their opposing chambers 44 are expanding under the influence of the pressurized gas. The use of such inlet ports as secondary exhaust ports, relative to the centrally-located primary uniflow-type exhaust ports 90, minimizes back pressure against each piston 42 after its progress has closed the primary exhaust port 90, thereby further aiding power output and efficiency.

Although it is preferable to use the inlet ports 86 and 88 also as the secondary exhaust ports as described, separate secondary exhaust ports could alternatively be used. Also, although both the inlet ports 86 and 88 are shown communicating through the same head 28 of the cylinder block 24 for simplicity, one set of inlet ports (such as 88) could alternatively communicate through the opposite head 26 of the cylinder block.

The terms and expressions which have been employed in the foregoing specification are used therein as terms of description and not of limitation, and there is no intention, in the use of such terms and expressions, of confining the invention to the features shown and described or portions thereof, nor of excluding equivalents thereof, it being recognized that the scope of the invention is defined and limited only by the claims which follow.

What is claimed is:

1. A reciprocating piston-type engine comprising:

(a) an engine housing;

(b) a drive shaft extending longitudinally through said housing rotatably journaled thereto;

c) a cylinder block fastened coaxially about said drive shaft within said housing so as to rotate in unison with said drive shaft, said cylinder block defining a plurality of cylinders having axes generally parallel with the axis of said drive shaft and spaced radially about said drive shaft;

d) a torque conversion plate attached to said drive shaft so as to rotate about said shaft in unison with said shaft and cylinder block, said plate being journaled to said housing so as to rotate about an axis which is tilted with respect to the axis of said drive shaft;

e) a reciprocating piston within each of said cylinders attached to said torque conversion plate at a respective location spaced radially from the axis of rotation of said plate;

(f) each of said cylinders defining a pair of chambers separated by said reciprocating piston, each of said pair of chambers having respective inlet port means for admitting pressurized gas into said pair of chambers to drive said piston bidirectionally by expansion of said gas within said pair of chambers, each of said respective inlet port means including means for admitting pressurized gas, to a respective one of said pair of chambers, separate from gas contained within the other of said pair of chambers; and (g) an exhaust conduit interconnecting each of said pair of chambers with said inlet port means for recycling said gas from said chambers to said inlet port means.

2. The engine of claim 1 including means for selectively controlling said inlet port means to rotate said cylinder block and shaft alternatively in either of two opposite directions.

3. The engine of claim 1 wherein each said piston has a respective elongate piston rod movably attached to said piston and to said torque conversion plate, each said respective piston rod communicating longitudinally between the interior and exterior of a respective one of said cylinders through a respective seal movably mounted on said cylinder block so as to move sealably in multiple directions transverse to the length of said respective piston rod.

4. The engine of claim 3 wherein each said respective seal is slidable in said multiple directions relative to said cylinder block.

5. The engine of claim 3 wherein each said respective piston rod is longitudinally rotatable with respect to said respective seal.

6. A reciprocating piston-type engine comprising:

(a) an engine housing;

(b) a drive shaft extending longitudinally through said housing rotatably journaled thereto;

(c) a cylinder block fastened coaxially about said drive shaft within said housing so as to rotate in unison with said drive shaft, said cylinder block defining a plurality of cylinders having axes generally parallel with the axis of said drive shaft and spaced radially about said drive shaft;

(d) a torque conversion plate attached to said drive shaft so as to rotate about said shaft in unison with said shaft and cylinder block, said plate being journaled to said housing so as to rotate about an axis which is tilted with respect to the axis of said drive shaft;

(e) a reciprocating piston within each of said cylinders attached to said torque conversion plate at a respective location spaced radially from the axis of rotation of said plate;

(f) each of said cylinders defining a pair of chambers separated by said reciprocating piston, each of said pair of chambers having respective inlet port means for admitting pressurized gas into said pair of chambers at substantially equal pressures to drive said piston bidirectionally by expansion of said gas within said pair of chambers;

(g) each of said cylinders having opposite ends, primary exhaust port means located between said opposite ends for selectively exhausting said gas from said pair of chambers in response to movement by said piston, and respective secondary exhaust port means each located adjacent a respective one of said opposite ends for further exhausting said gas from a respective one of said chambers, further including control means for selectively controlling each of said respective secondary exhaust port means to exhaust said gas from a respective chamber through said respective secondary exhaust port means when said respective inlet port means associated with said respective chamber is not admitting pressurized gas into said respective chamber and said primary exhaust port means is not exhausting said gas therefrom.

7. The engine of claim 6 wherein said respective secondary exhaust port means and inlet port means share respective common gas passageways, said control means comprising valve means for selectively either introducing said pressurized gas into said common gas passageways or exhausting said gas therefrom.

8. A reciprocating piston-type engine comprising:

(a) means defining at least one cylinder in which a piston reciprocates, said cylinder defining a pair of chambers separated by said piston, each of said pair of chambers having respective inlet port means for admitting pressurized gas into said pair of chambers to drive said piston bidirectionally by expansion of said gas within said pair of chambers;

(b) said cylinder having opposite ends, primary exhaust port means located between said opposite ends for selectively exhausting said gas from said pair of chambers in response to movement by said piston, and respective secondary exhaust port means each located adjacent a respective one of said opposite ends for further exhausting said gas from a respective one of said chambers; and (c) control means for selectively controlling each of said respective secondary exhaust port means to exhaust said gas from a respective chamber through said respective secondary exhaust port means when said respective inlet port means associated with said respective chamber is not admitting pressurized gas into said respective chamber and said primary exhaust port means is not exhausting said gas therefrom.

9. The engine of claim 8 wherein said respective secondary exhaust port means and inlet port means share respective common gas passageways, said control means comprising valve means for selectively either introducing said pressurized gas into said common gas passageways or exhausting said gas therefrom.

* * * * *